United States Patent [19]

Zaremba

[11] 4,174,011

[45] Nov. 13, 1979

[54] SUBSEA DRILLING TEMPLATE WITH CAROUSEL GUIDANCE SYSTEM

[75] Inventor: Hubart B. Zaremba, London, England

[73] Assignee: Standard Oil Company (Indiana), Chicago, Ill.

[21] Appl. No.: 832,141

[22] Filed: Sep. 12, 1977

[51] Int. Cl.[2] ..... E21B 15/02

[52] U.S. Cl. ..... 175/7; 166/366; 166/341

[58] Field of Search ..... 175/5, 7; 166/0.5, 0.6, 166/79, 94, 366, 341, 338, 342

[56] References Cited

U.S. PATENT DOCUMENTS

| | | | |
|---|---|---|---|
| 3,308,881 | 3/1967 | Chan et al. | 175/7 |
| 3,500,906 | 3/1970 | Petersen | 166/0.6 |
| 3,542,125 | 11/1970 | Sizer | 166/0.6 |
| 3,777,812 | 12/1973 | Burkhardt et al. | 166/0.6 |
| 3,789,921 | 2/1974 | De Chassy et al. | 166/0.5 |
| 3,987,638 | 10/1976 | Burkhardt et al. | 179/9 X |
| 4,068,729 | 1/1978 | Peevey | 166/0.5 X |

*Primary Examiner*—Ernest R. Purser
*Assistant Examiner*—Richard E. Favreau
*Attorney, Agent, or Firm*—John D. Gassett

[57] ABSTRACT

A sea floor template with vertical well guides or slots is lowered to the sea floor. Guide rails, such as a railroad track, are supported on top of the frame of the template in a path which extends along each well slot. A drilling guidance carousel is lowered to the template. Rollers on the drilling guidance carousel engage guide rails so that the carousel can be moved to each template well slot. Guidelines extend from the drilling guidance carousel to a floating drilling vessel for guiding drilling equipment from the vessels down through the template well slot which is aligned with the carousel well slot. Preferably, the template well slots are arranged in a circle at each corner of a rectangular sea floor template. The guide rails are arranged concentrically with the central axis of the circle of template well slots. Locking means are provided to hold the carousel drilling frame well slot aligned with any selected one of the well slots in the sea floor template.

8 Claims, 8 Drawing Figures

SUBSEA DRILLING TEMPLATE WITH CAROUSEL GUIDANCE SYSTEM

BACKGROUND OF THE INVENTION

Field of the Invention

This invention relates to a guidance method for a system for locating wells in a sea floor which are to be drilled from a floating vessel.

In recent years there has been considerable attention attracted to the drilling and production of wells located in water. Wells may be drilled in the ocean floor from either fixed platforms in relatively shallow water or from floating structures and vessels in deep water. The most common means of anchoring fixed platforms includes the driving, or otherwise anchoring, of long piles in the ocean floor. Such piles normally extend above the surface of the water and support a platform attached to the top of the piles. This works fairly well in shallow water but, as the water gets deeper, the problems of design and accompanying cost become prohibitive. In deeper water, it is common practice to drill from a floating structure.

In recent years there has been considerable attention directed toward many different kinds of floating structures. One system receiving attention is the so-called Verically Moored Platform. Such a platform is described in U.S. Pat. No. 3,648,638 issued Mar. 14, 1972, Kenneth A. Blenkarn, inventor. Key features of the disclosure in that patent are that the floating platform is connected to an anchor only by elongated parallel members and the floating structure has buoyancy means designed especially with respect to the trough of a design wave so as to minimize variations in vertical forces imposed on the vertically elongated members which may be caused by passing waves. The are other types of floating drilling structures such as the semisubmersible and the floating drilling vessel with a "moon pool" or vertical opening through the center through which drilling operations are carried out. The drilling engineer selects a floating vessel which he believes will best fit the environmental conditions which are expected to be encountered.

The closest prior art relating to my invention, to the best of my knowledge, concerns frames on the ocean floor having a vertical passage through which a well may be drilled. The drilling tool is guided into the vertical passage by cables extending from the frame to a floating vessel. None of the prior art has means for sequentially guiding drilling pipe or mechanisms successively through each of an array of vertical holes through a sea floor template.

Brief Description Of The Invention

This concerns means for guiding a drilling mechanism, such as a drill bit, casing string, blowout preventer, etc., into any selected one well slot of a sea floor template. The sea floor template is provided with a number of well slots or vertical openings arranged in a selected pattern. Guidelines are attached between the floating vessel and a movable carousel guidance frame. The frame has a vertical opening, or well slot, therethrough. Means are provided to align the opening of the movable frame with any of the well slots of the template.

Preferably, the sea floor template is arranged so that it has four corners which define a rectangle. Preferably, at each of these corners there is provided a plurality of well slots which are arranged in a pattern approximating a circle. Two concentric circular rails are provided which are also concentric to the circle of template well slots. One such guide rail is of smaller diameter than said circle, and the other is larger. A carousel guidance or anchor frame is mounted so it can move along these two concentric rails. Moving and orienting means are provided to move this frame from above one template well slot to any other selected one. A well is then drilled from the floating vessel through the well slot in the carousel guide frame and the well slot in the sea floor template. This includes the running of casing, etc. After a well is drilled, the carousel guide frame is moved to the next selected template well slot.

A better understanding of the invention may be had from the following description taken in conjunction with the drawings.

DRAWINGS

DETAILED DESCRIPTION

Figure 1:
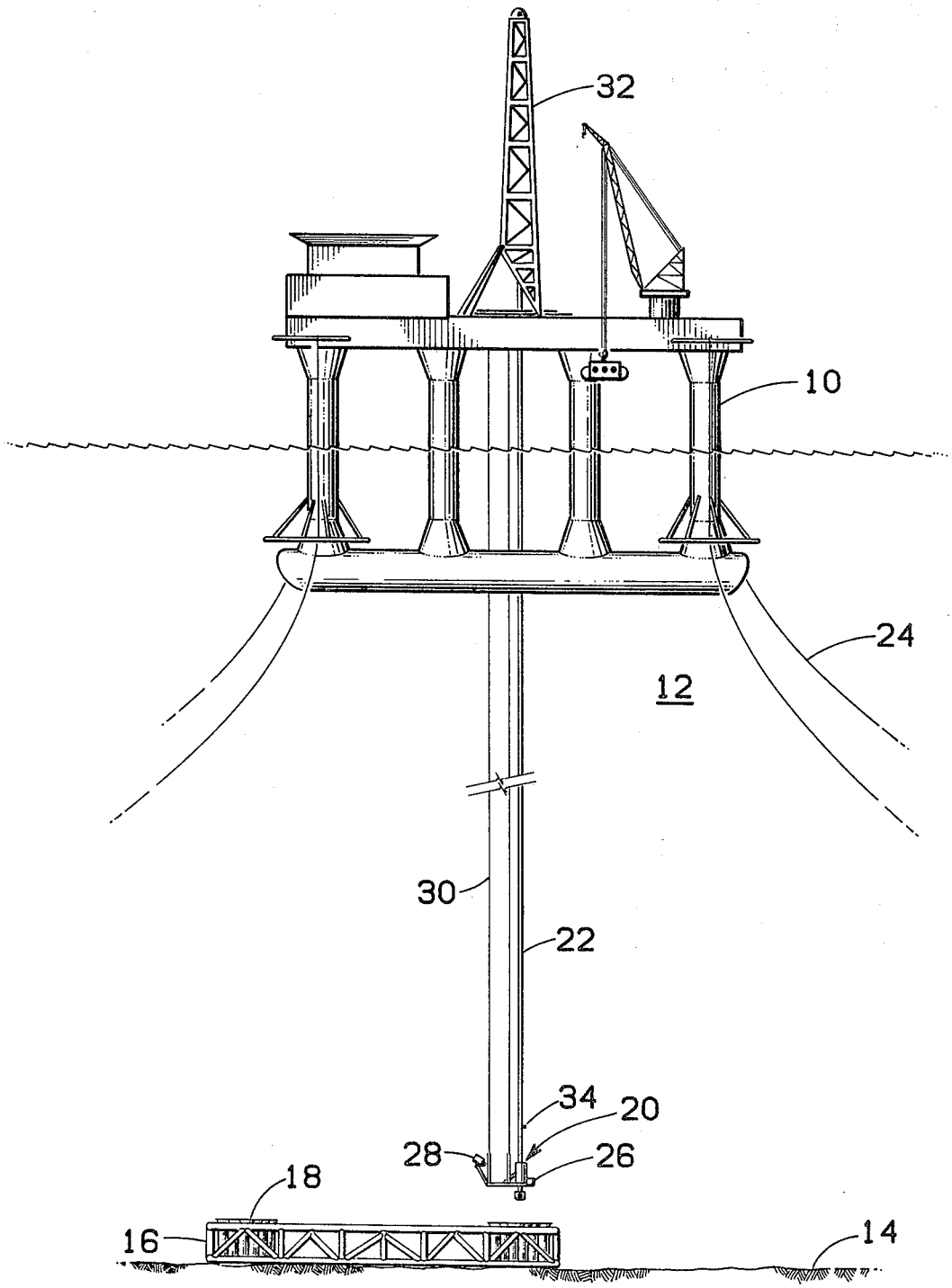
FIG. 1 illustrates a drilling guidance carousel being lowered by a running string from a floating vessel to a sea floor template.

Attention is next directed to the drawings, and in particular to FIG. 1. Shown thereon is a floating vessel 10 supported in a body of water 12 above the sea floor 14. Located on the floor 14 is a sea floor template 16 having a plurality of vertical well guides or slots 18. The template 16 can be lowered to the position shown in FIG. 1 by cables supported from a floating barge. A drilling guidance carousel 20 is suspended at the lower end of a running string 22 supported from the floating vessel 10. The running string 22 can be a small diameter steel pipe, e.g., 2½ inches in diameter. Vessel 10 can be essentially any floating vessel. Vessel 10 has anchor mooring lines 24. It is also possible that vessel 10 might be provided with dynamic positioning means. Near the lower end of the drilling guidance carousel 20 is an acoustic location device 26. The drilling guidance carousel also preferably is provided with a TV camera and lights 28. Acoustic location device 26 and TV camera and light means 28 may not always be necessary, but will usually aid in the rapid orientation of the drilling guidance carousel 20 with the sea floor template 16. Guidelines 30 are provided between drilling guidance carousel 20 and the floating vessel 10. The upper end of guidelines 30 are connected on the vessel to drums or constant tension devices which are well known. Shown on vessel 10 is a drilling rig 32 and other drilling equipment is indicated thereon. If desired, thrust means 34 such as a water jet can be provided at the lower end of running string 22 to move the lower end as may be necessary. Proper orientation of drilling guidance carousel 20 with the sea floor template 16 is facilitated by use of TV camera 28, acoustic location device 26 in conjunction with transponder 46 (indicated in FIG. 3) on the sea floor templates, the jetting means 34, and by manipulating the running string at the surface of vessel 10.

Figure 2:
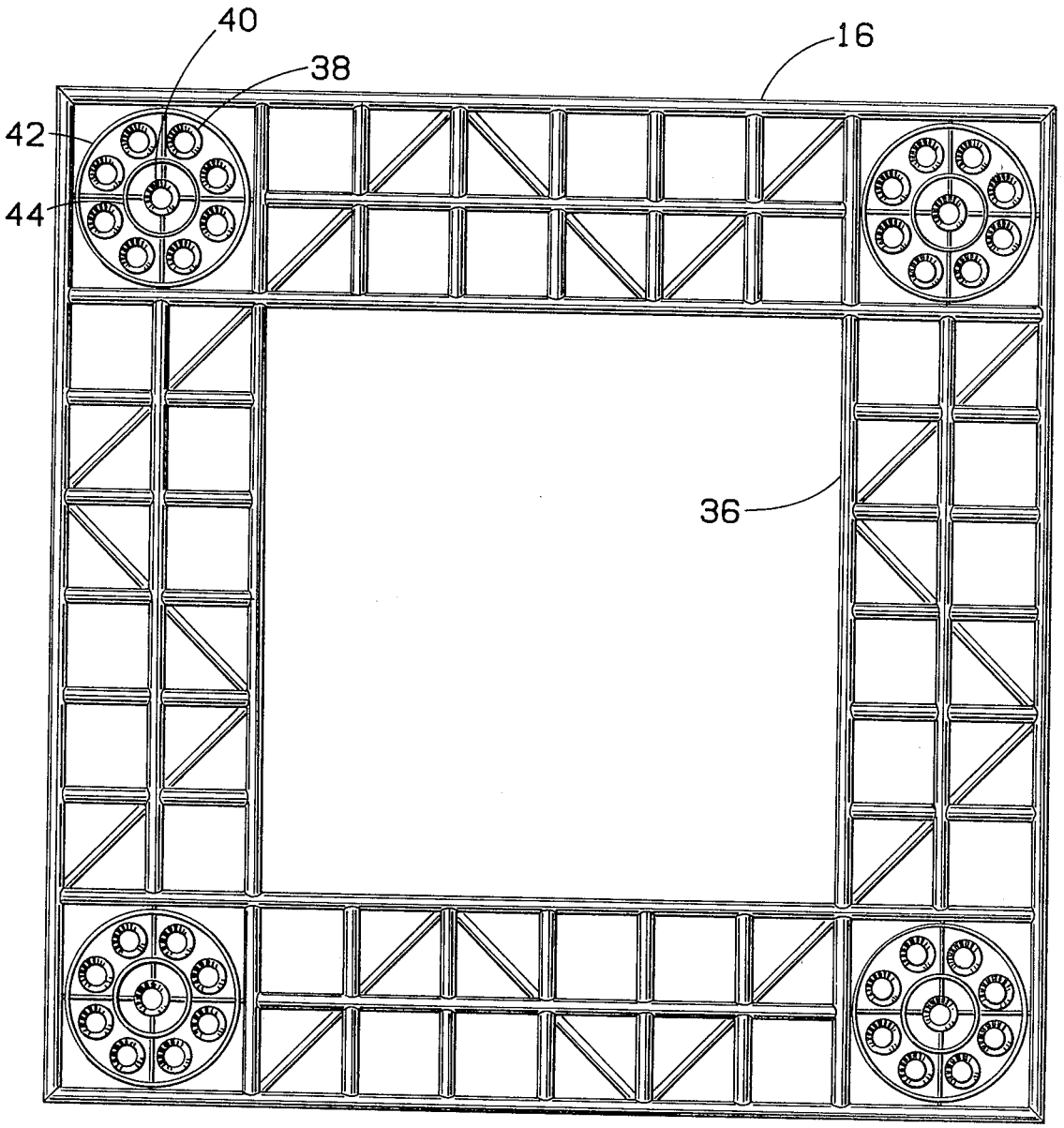
FIG. 2 illustrates a simplified plan view of a sea floor template.

Attention is next directed to FIG. 2, which illustrates a plan view of a preferred arrangement and pattern of sea floor template 16 of FIG. 1. This template has frame members 36, which define a square and in which there is a pattern of vertical well slots 38 in each corner of the configuration. Well slots 38 are arranged in a circle about a center carousel guidance slot 40. These vertical well slots 38 are supported by means from the sea floor template 16. Concentric guide rails 42 and 44 are provided. These guide rails are also concentric with the circle formed by the center of well slots 38.

Figure 3:
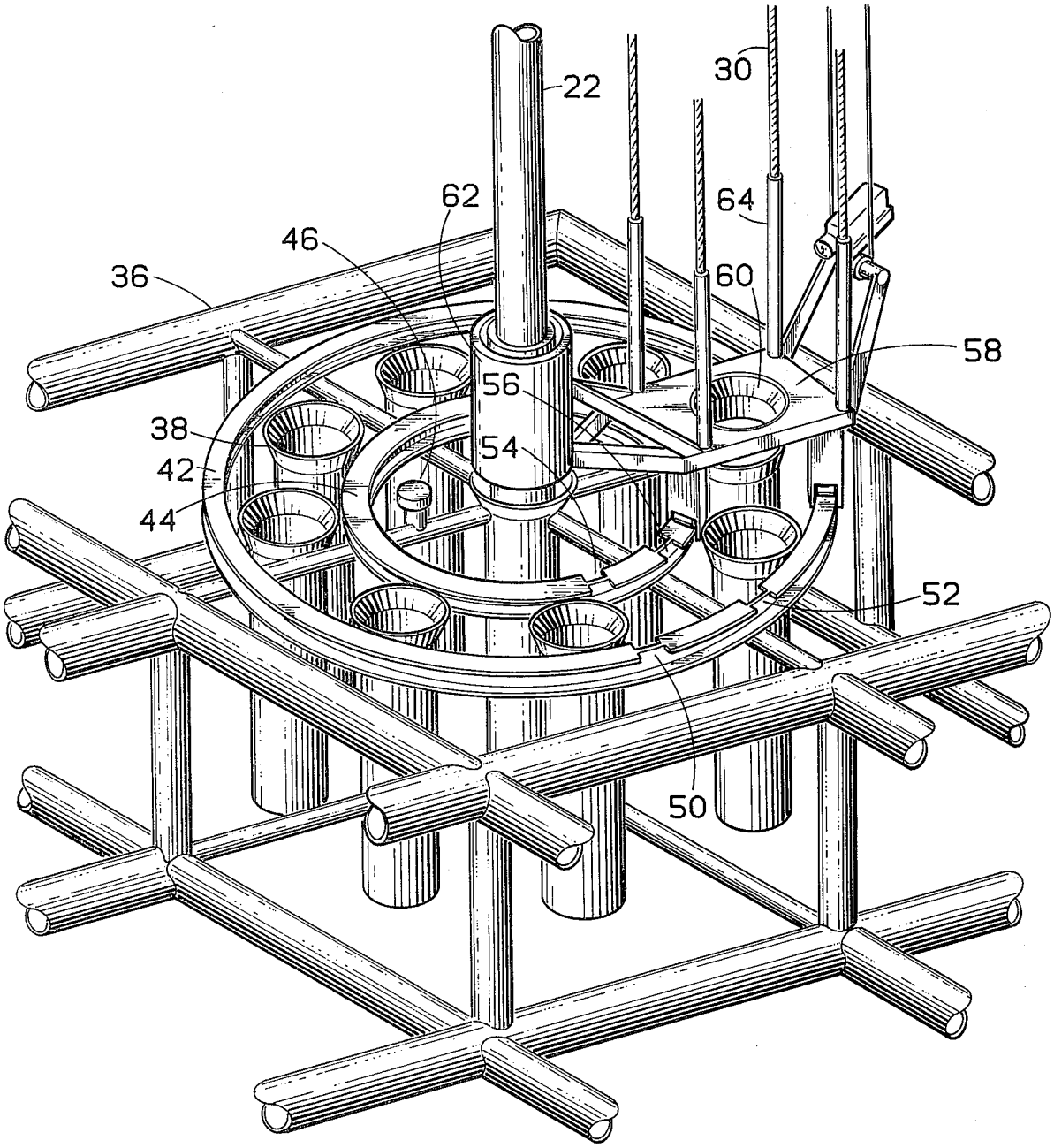
FIG. 3 illustrates an isometric view of one corner of the sea floor template illustrated in FIG. 2.

Attention is next directed to FIG. 3 which illustrates one corner in isometric form of the template of FIG. 2 with the drilling guidance carousel in position. Shown in FIG. 3 is template frame 36 having vertical template well guides 38. These well guides 38 are supported from frame 36 by means not specifically shown, but support can be by essentially any conventional method such as by welding of cross braces, etc. Mounted in a concentric circle on either side of well guides 38 are outer guide rail 42 and inner guide rail 44, which are also supported from frame 36. Rails 42 and 44 have guide rails engaging slots 50, 52, 54, and 56. The purpose of these guide rails engaging slots is to permit the lower rollers of the carousel guidance system to enter under the top of the rails 42 and 44 and resist upward pull on the carousel guidance frame as will be seen hereinafter.

The drilling guidance carousel includes a carousel guide frame 58 having a guidance frame well slot 60 and a pivoting and orienting means 62. Carousel guidance frame 58 is provided with a plurality of guideposts 64 which are connected to guidelines 30 which extend to drilling support structure such as floating vessel 10 as shown in FIG. 1. A transponder 46 is also illustrated which is helpful in orienting the drilling guidance carousel when it is first being lowered to the sea floor template. There are shown four guideposts 64 which are arranged in a square about carousel guidance frame well slot 60. These guidelines 30 are used to guide drilling equipment, casing, etc., through the slot 60 and the well slot 38 with which it is aligned.

Figure 4:
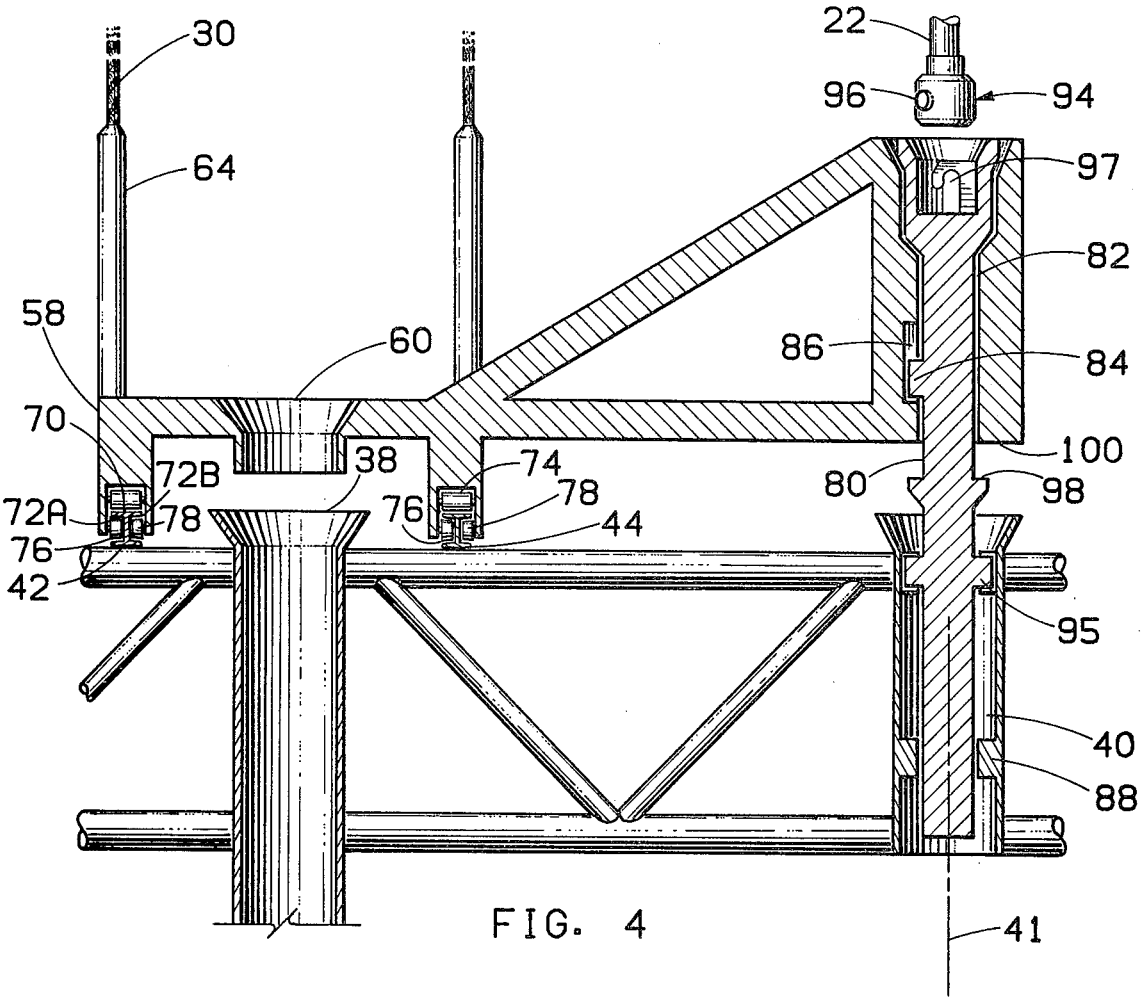
FIG. 4 illustrates, partly in section, a drilling guidance carousel in engagement with the sea floor template.

Attention is next directed to FIG. 4 which shows partly in vertical section the drilling guidance carousel in place on the sea floor template. Guide rails 42 and 44 are typically shaped as I-beams with the upper portion having an upper riding surface 70 and lower undersurfaces **72*a* and 72*b* on each side of the vertical support portion of the I-beam. Guide rails 42 and 44 support carousel guide frame 58, which has upper or main rollers 74 which ride, or bear, against the upper surface 70 of the guide rails. Carousel guidance frame 58 also has retaining rollers 76 and 78 which pass downward through guide rail engaging slots 50, 52, 54, and 56 (shown in FIG. 3). After these rollers pass through the engaging slots, the guidance frame is rotated away from the slots before applying tension sufficient to lift guidance frame 58. Upon rotational movement of the carousel guiding frame, rollers 76 and 78 bear against lower surface 72*a* and 72*b* of the guide rails when upward tension is applied to guide cables 30. In other words, main roller 74 is for supporting the guidance frame 58 when it is being rotated about the guidelines or when guidelines 30 are not in tension. When guidelines 30 are under tension, then retaining rollers 76 and 78 restrain the carousel guide frame 58. There are four sets of rollers 74, 76, and 78, one being at each corner of guidance frame 58**.

Figure 5:
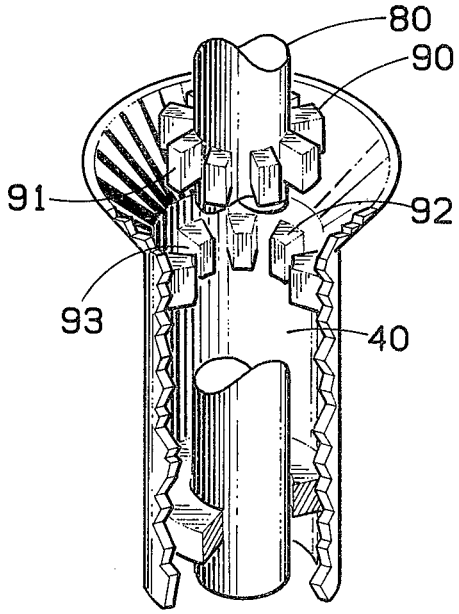
FIG. 5 is a partial cutaway perspective view of the locating mechanism of FIG. 4 for orienting the well slot of the carousel guidance frame and a selected well slot of the sea floor template.

Carousel guidance frame 58 rolls along guide rails 42 and 44 which are fixed to a sea floor template frame 36 about a pivot point. The center of the circles defined by guide rails 42 and 44 is the center of the centerline 41 of carousel guidance slot 40. This is accomplished by use of an orienting and turning pin, or post 80. Turning post 80 extends through a vertical slot 82 in the arm of carousel guidance frame 58. Orienting and turning post 80 has turning splines 84 which mate with internal splines 86 within passage 82 of the carousel guidance frame 58. Turning splines 84 are of less (e.g., one-half) vertical length than splines 86. This is to permit vertical movement of post 80 with respect to carousel guidance frame 58 so that the orienting and turning post 80 can have limited vertical movement with respect to the carousel guidance frame 58. Orienting and turning post 80 extends into carousel guidance slot 40 of sea floor template 16 which has a centering ring 88 at the lower portion thereof. This is primarily to aid stability to the post 80. As seen more clearly in FIG. 5, post 80 has locating gear teeth 90. On the interior of carousel guidance slot 40 there are provided mating gear teeth 92 which mate with locating gear teeth 90.

I will now describe that portion of FIG. 4 which has to do with (a) lifting the carousel and (b) turning it. This includes a running and turning J-slot 97, which is provided in the upper end of orienting and turning post 80. Running string 22 is provided with a running and turning tool 94, which has a running and turning lug 96.

The turning tool 94 is used for lowering, raising, and turning the carousel guidance frame 58. The running tool 94 is shown in FIG. 1 as engaged with the running and turning J-slot 94 of pin 80. When in this position, lifting shoulder 98 on post 80 is in engagement with lower shoulder 100 of the portion of carousel guidance frame 58 having vertical passage 82. The running string 22 is lowered until the drilling guidance carousel 26 is in position above the selected well slot 38 of the sea floor template. This is accomplished by use of the acoustic locating device 27 in relation with transponder 46 on the template. TV camera 28, with lights, is also utilized and, if necessary, fluid is passed down through running string 22 and out jetting means 34 to drive the pipe in the proper direction. The proper direction can be obtained by rotating the running string 22 at the surface. One first must make a decision as to which one of the corners of the template shown in FIG. 2 it is desired to drill. Then the running string lowers the drilling guidance carousel until post 80 is aligned with the selected carousel guidance slot 40. Then the carousel guidance frame 58 is rotated until rollers 76 and 78 are aligned with the guidance rail engaging slots 50, 52, 54, and 56 which are illustrated in FIG. 3. Then the running string is lowered until each of rollers 76 and 78 is passed through the slots. The carousel guidance frame 58 is next rotated so that the frame is secured to guide rails 42 and 44. During this time, orienting and turning post 80 is in its upward position so that shoulder 98 is against lower shoulder 100 of the carousel guidance frame 58. The running string 22 is used to rotate the carousel guidance frame 58 until the carousel guidance frame well slot 60 is aligned with the selected well slot 38 of the sea floor template. At this time, running string 22 is lowered so that locating gear teeth 90 of orienting and turning post 80 engages mating gear teeth 92. The carousel guidance frame is thus locked in position.

There are two points which should be considered at this time. One is that the carousel guidance frame is so designed in connection with the template that when carousel guidance frame well slot 60 is above a selected well slot 38 of the sea floor template, then a selected gear tooth 91 of locating gear teeth 90 is in an oriented position with respect to tooth space 93 of mating gear teeth 92. Locating gear teeth 90 and mating gear teeth 92 are of proper size and design so that there is orientation for each of the well slots 38 of the sea floor template. Secondly, it is important to note that turning spline 84 of orienting and turning post 80 has a vertical movement with respect to spines 82 of the carousel guidance frame 58 so that locating gear teeth 90 can be raised to the position shown in FIG. 5 while the rollers 78 and 76 are in full engagement with tracks 42 and 44. Whenever the carousel guidance frame well slot 60 is aligned with well slot 38 of the sea floor template, drilling tools can be run along guidelines 30 and drilling can progress in the usual manner. This carousel guidance frame can be rotated so that each well slot 38 of the selected corner of the sea floor template 16 is drilled. When all the wells have been drilled in the well slots 38 as desired, the drilling guidance carousel is removed. This is easily accomplished by aligning the rollers of the carousel guidance frame 58 with the guide rail engaging slots 50, 52, 54, and 56. At this time, all that is necessary to remove the drilling guidance carousel 26 is to raise up on running string 22. Cables 30 should also be lifted or wound on a drum at the surface. It will normally be desired to move over to another corner of the sea floor template shown in FIG. 2. Then the sequence of events described for lowering, engaging, rotating and removing the carousel guidance device is repeated for each corner of the sea floor template. This is continued until wells have been drilled through each of the well slots desired.

Figure 6:
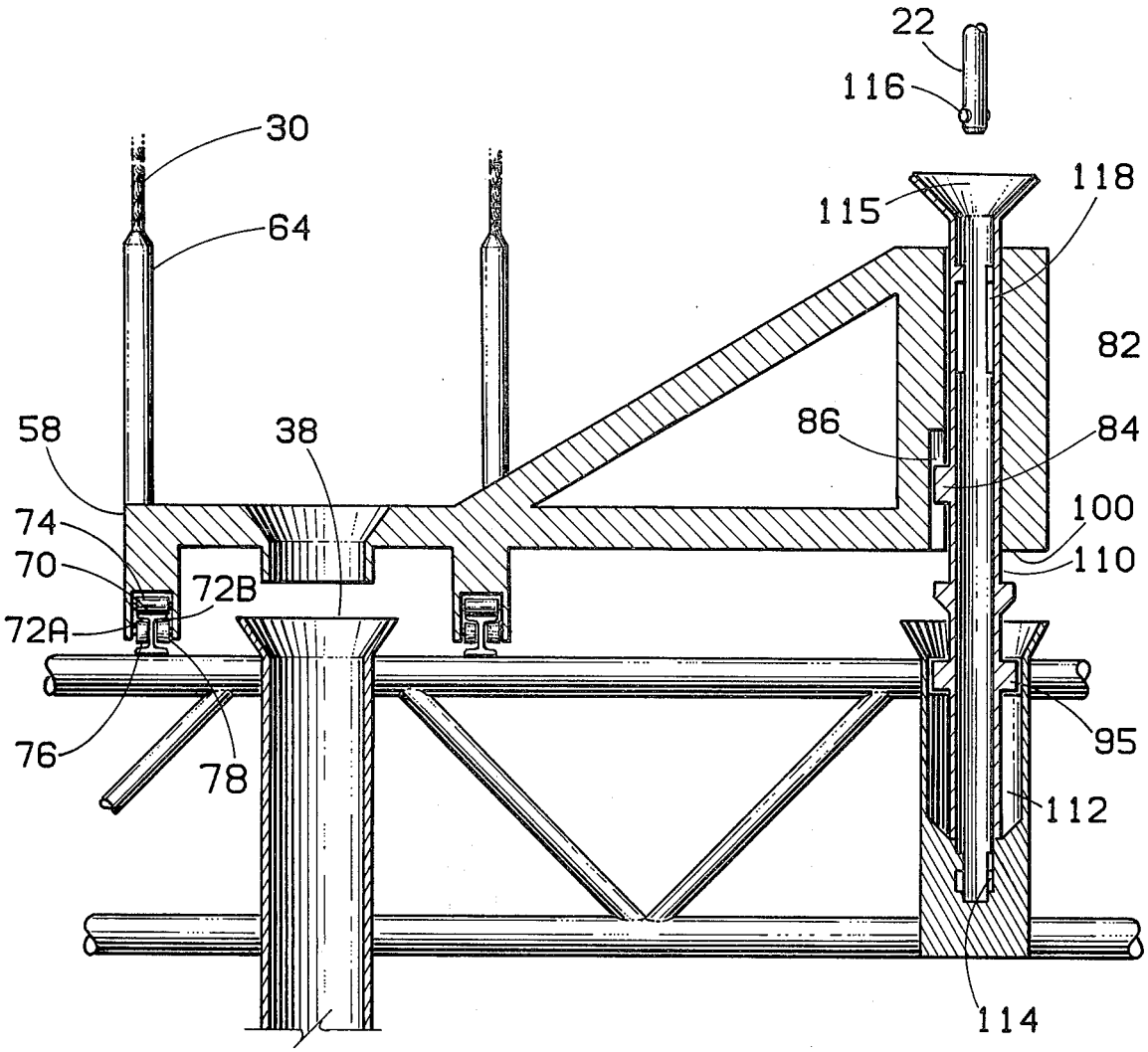
FIG. 6 is similar to FIG. 4, but illustrates a device whereby the pivot post of the carousel guidance system is run separately from the carousel guidance frame.
Figure 7:
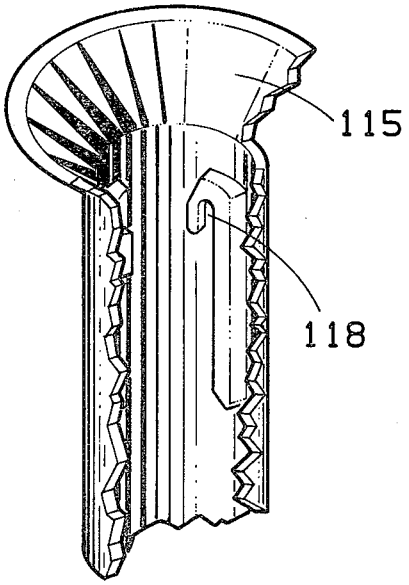
FIG. 7 illustrates the upper end of a pivot post of FIG. 6.
Figure 8:
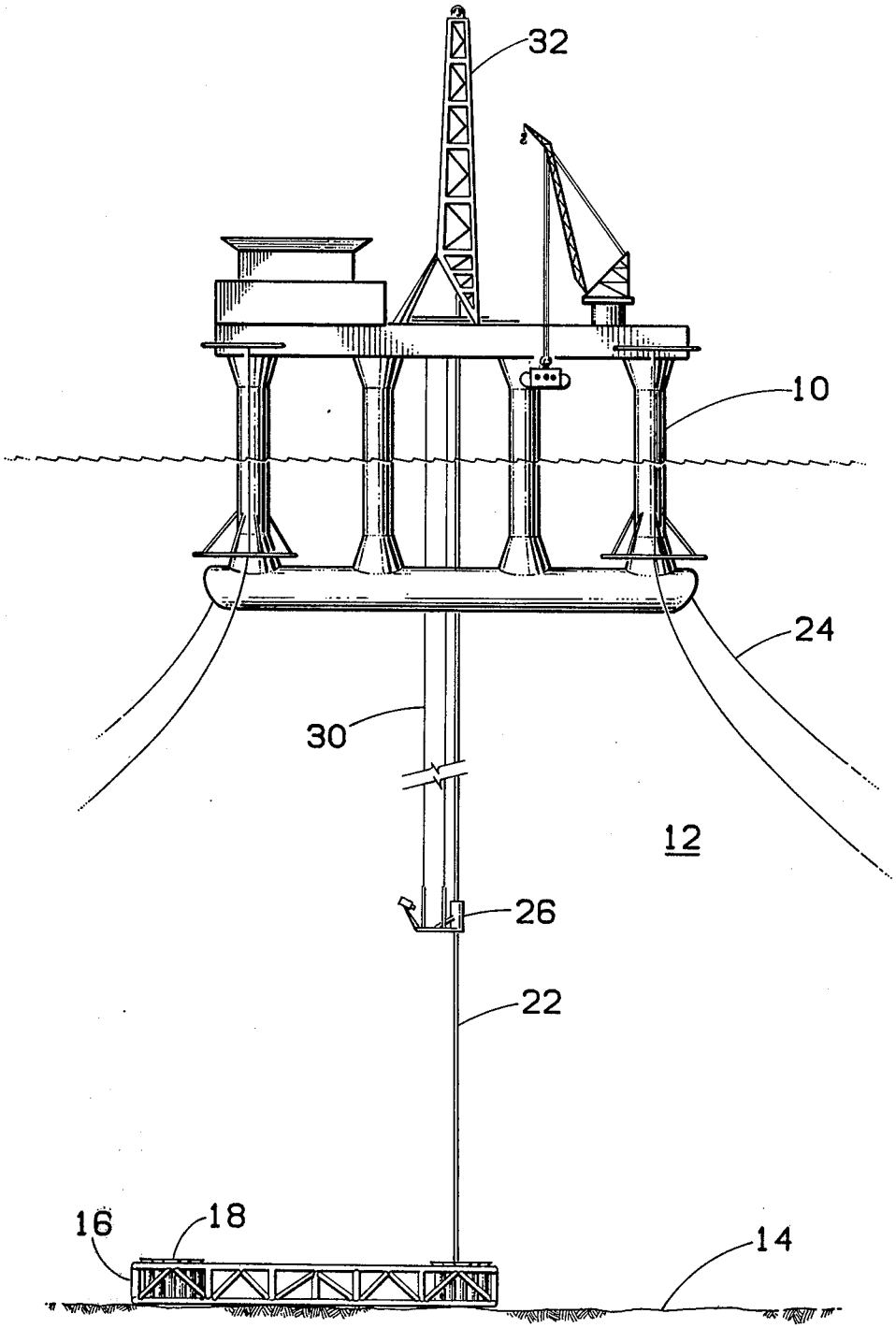
FIG. 8 is similar to FIG. 1, but using a modified drilling guidance carousel.

In the device described above in connection with FIGS. 4 and 5, the drilling guidance carousel 26 was lowered at the same time that running string 22 was lowered. Attention is now directed to FIGS. 6 and 7 in which the running string 22 is first run and lowered into anchored position and then the guidance frame 58 is lowered down over the running string 22. The main modification in FIGS. 6 and 7 is in the orienting and turning post 110, which serves the same functions as orienting and turning post 80 of FIG. 4. The sea floor template is provided with a carousel guidance slot 112, which is modified from the carousel guidance slot 40 of FIG 4. In FIG. 6 the lower end of slot 112 is provided with a running tool locking means 114 such as a J-slot. The running tool 22 is provided with running tool lugs 116. In operation, before the carousel guidance frame 58 is lowered, running tool 22 is lowered and lugs 116 engage running tool locking means 114 in the bottom of carousel guidance slot 112. At this time, as shown in FIG. 2, the drilling guidance carousel 26 is lowered by cables 30 over running string 22 which has previously been centered and locked in guidance slot 112. Orienting post 110 of the carousel 26 arrangement of FIGS. 6 and 7 is modified to provide for a vertical passage therethrough with funnel 115 at the top for receiving running tool 22. There is also provided a turning device such as J-slot 118 in the upper end of post 110. The locking gears 95 and the turning splines 84 and 86 of the device in FIG. 6 can be the same as those of FIGS. 4 and 5. An advantage of the device of FIG. 6 over that of FIG. 4 is that it permits the running string 22 to be locked into the carousel guidance slot 112 before the drilling guidance carousel is lowered. This permits the running string 22 to be manipulated without the additional weight of the carousel guidance device thereon, which simplifies the orientation problem. If desired, a camera and acoustic locating device can be run with running tool 22 until the lugs 116 are locked into J-slot 114. Then the camera transponder can be recovered by cables which were attached at the time it was lowered with the running string 22. The carousel guidance device 26 is then lowered by cables 30. The device of FIG. 6 can be used in the same manner as that of FIG. 4 for drilling through a selected well slot 38 of the sea floor template.

The turning mechanisms in FIGS. 4 and 6 are shown to be at the pivot point or center of the circles of the rails 42 and 44. However, if desired, the turning mechanism could be made, for example, by providing J-slots elsewhere at any position where it may be determined to be more desirable on the carousel guidance arm 58, which would match with a turning lug such as 116 of running string 22.

While the above invention has been described in detail, various modifications can be made thereto without departing from the spirit or scope of the invention.

What is claimed is:

1. A drilling guidance carousel for use in driling underwater wells from a floating vessel which comprises
- a carousel guidance frame,
- a carousel guidance frame well slot in said carousel guidance frame,
- guideposts arranged in a pattern about said well slot and secured to said carousel guidance frame,
- a vertical turning post slot 82 extending through said carousel guidance frame,
- an orienting and turning post mounted in said slot 82,
- means permitting limited vertical movement of said post through said post slot 82,
- spline means between said post and said carousel guidance frame,
- locking gears surrounding the periphery of said turning post below said carousel guidance frame,
- torque resistance means 118 in the upper end of said post and in which said post is hollow.

2. A drilling guidance carousel as defined in claim 1 in which said torque resistance means is a J-slot in the upper end of said post.

3. A sea floor template for use with a guidance system for drilling underwater wells from a floating vessel which comprises:
- a template frame,
- a group of well slots arranged in a circle and supported by said template frame,
- an outer guide rail and an inner guide rail supported by said template frame and extending adjacent said circle of well slots, said guide rails being concentric with each other and with said circle, said guide rails are in the form of an I-beam having an upper flat rim extending on either side of a vertical support member, said rim being cut in two places on said outer guide rail and two places on said inner guide rail, defining a quadrant.

4. A template as defined in claim 3 including a central vertical guidance slot located in the center of said circle and supported by said template frame and in which said carousel vertical guidance slot includes orienting gear teeth arranged in a circular pattern about the interior of said slot.

5. A template as defined in claim 4 in which the lower end of said carousel guidance slot has a running tool locking means.

6. A sea floor template and drilling guidance carousel for use in drilling wells in the bottom of the body of water which comprises:

a template frame, a group of well slots arranged in a circular pattern and supported by said template frame, guide rails supported by said template frame and adjacent said pattern of well slots, a central vertical guidance slot located in the center of such circular pattern and supported by said template frame, internal locking gear means in said vertical guidance slot, a carousel guidance frame, a carousel guidance frame well slot in said carousel guidance frame, a vertical turning post slot extending through said guidance frame an orienting and turning post mounted in said slot, means permitting limited vertical movement of said post through said post slot, spline means between said post and said carousel guidance frame, locking gears surrounding the periphery of said turning post below said carousel guidance frame and mating with said internal locking gears of said central vertical guidance slot.

7. A template and drilling guidance carousel as defined in claim 6 including a J-slot in the upper end of said post.

8. A drilling guidance carousel for use in drilling underwater wells from a floating vessel which comprises:

a carousel guidance frame, a carousel guidance frame well slot in said carousel guidance frame, a vertical turning post slot extending through said carousel guidance frame, an orienting and turning post mounted in said slot, means permitting limited vertical movement of said post through said post slot, spline means between said post and said carousel guidance frame, locking gears surrounding the periphery of said turning post below said carousel guidance frame, torque resistance means in the upper end of said post.

* * * * *